US005172772A

United States Patent [19]

Kettner et al.

[11] Patent Number: 5,172,772

[45] Date of Patent: Dec. 22, 1992

[54] HYDRO-IMPULSE SCREW TOOL

[75] Inventors: Konrad K. Kettner; Heinz-Gerhard Anders, both of Aalen, Fed. Rep. of Germany

[73] Assignee: Cooper Industries, Inc., Houston, Tex.

[21] Appl. No.: 667,128

[22] Filed: Mar. 11, 1991

[51] Int. Cl.[5] ..... B25B 19/00

[52] U.S. Cl. ..... 173/93; 173/93.5; 173/104; 192/58 R

[58] Field of Search ..... 173/93, 93.5, 93.6, 173/104, 105; 192/58 R

[56] References Cited

U.S. PATENT DOCUMENTS

| | | | |
|---|---|---|---|
| 3,042,163 | 7/1962 | Lapsley | 192/58 R |
| 3,169,585 | 2/1965 | Maurer | 173/93 |
| 3,181,672 | 5/1965 | Swanson | 173/93 |
| 3,214,940 | 11/1965 | Kramer | 173/93 |
| 3,263,449 | 8/1966 | Kramer | 192/58 R |
| 3,908,768 | 9/1975 | Hess | 173/93 |
| 4,766,787 | 8/1988 | Sugimoto et al. | 173/93.5 |
| 4,830,549 | 5/1989 | Neumaier et al. | 173/104 |
| 4,838,133 | 6/1989 | Dainin | 173/93.5 |

*Primary Examiner*—Douglas D. Watts
*Assistant Examiner*—Scott A. Smith
*Attorney, Agent, or Firm*—Alan R. Thiele; Eddie Scott; Bruce Patterson

[57] ABSTRACT

This invention relates to a rotary impulse screwing device which generates only one pulse per rotation of the output shaft. Two main and two additional lamellas are adjustably positioned in the output shaft. The two main lamellas seal at a minimum of two times per rotation of the output shaft. The two additional lamellas are adjusted independently via separate recess tracks to ensure that each additional lamella seals at only one point per rotation of the output shaft. The independently articulated additional lamellas further ensure that the load on the output shaft bearing is symmetrical on non-impulse points of rotation.

7 Claims, 3 Drawing Sheets

FIG. 1
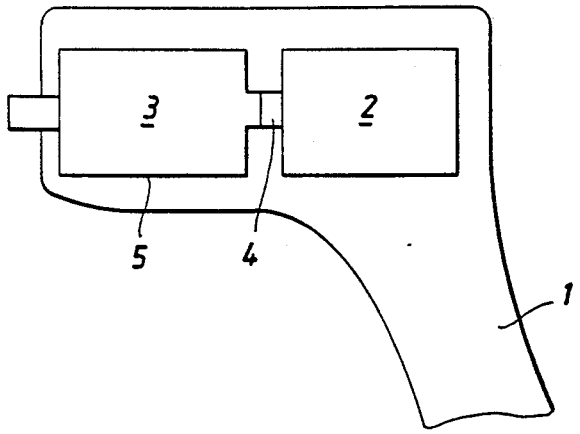
FIG. 2
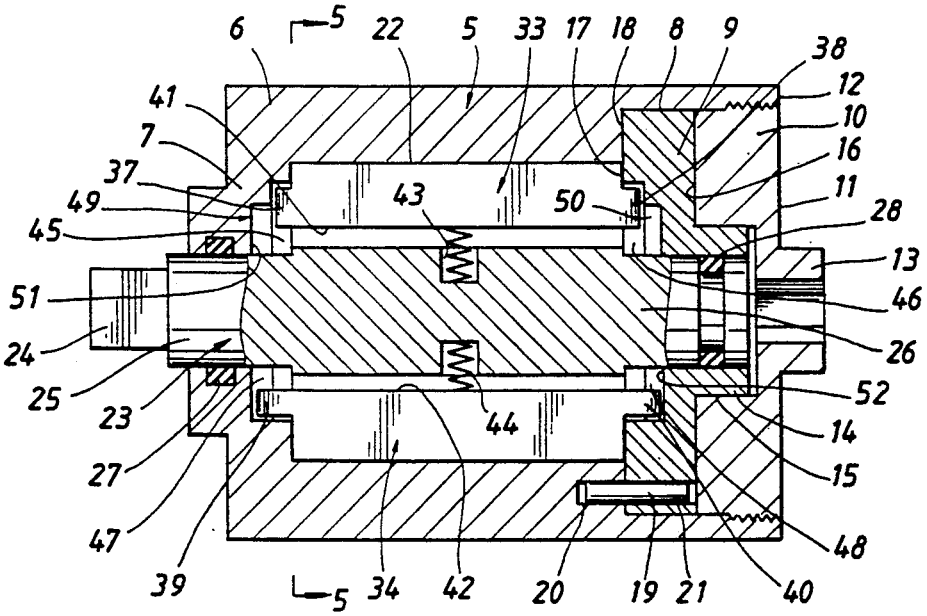
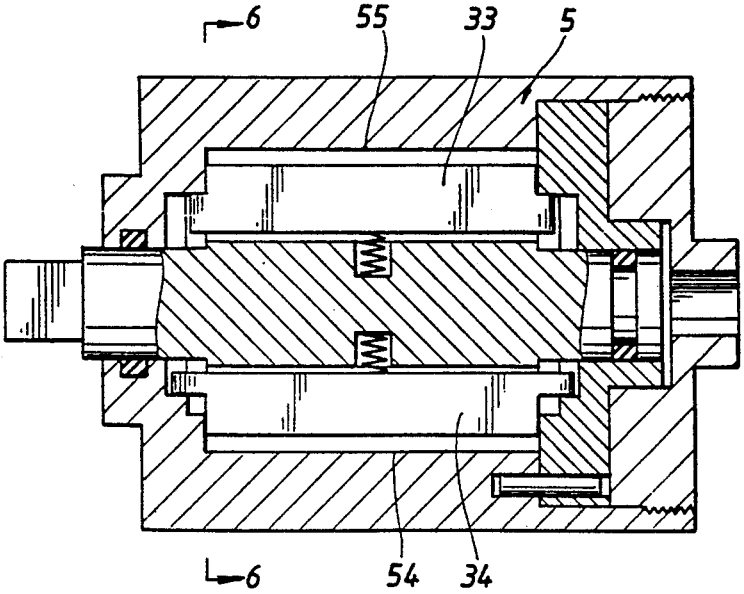
FIG. 3

FIG. 4
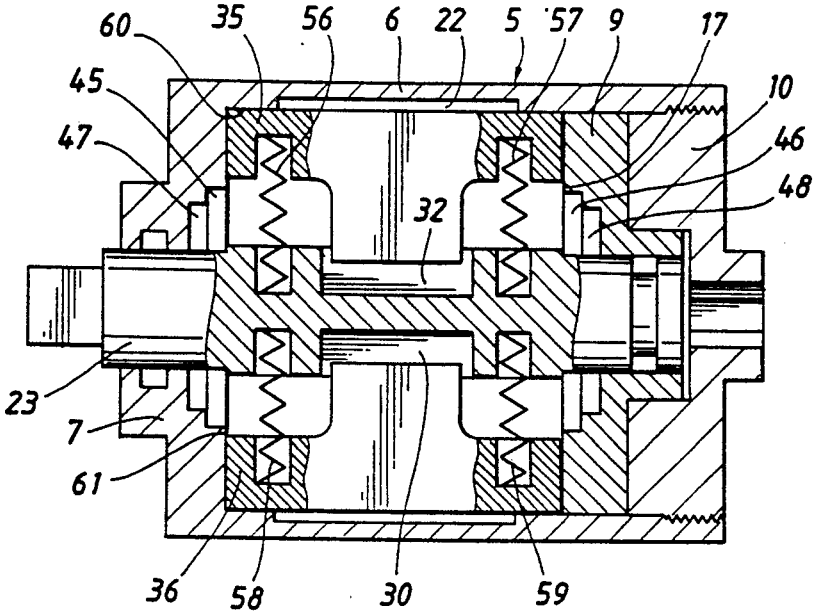
FIG. 5
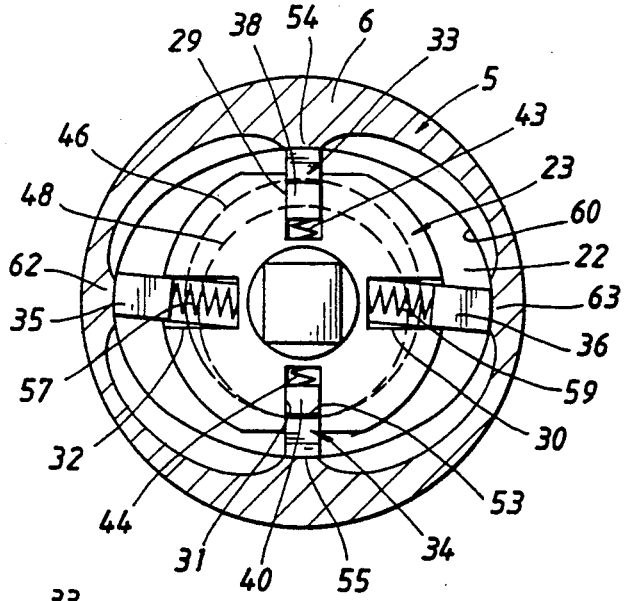
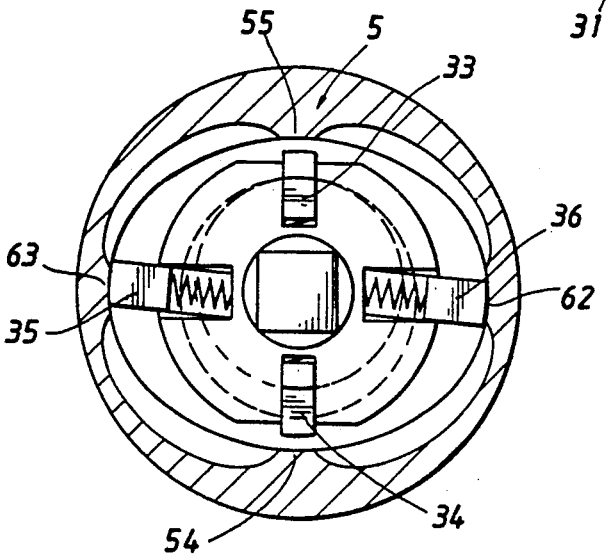
FIG. 6

HYDRO-IMPULSE SCREW TOOL

BACKGROUND OF THE INVENTION

The present invention relates to pneumatic power hand tools, more particularly, the present invention relates to hand held, pneumatic screw tools.

In the case of known Hydro-Impulse Screw Tools the main lamellas are pressed against the elliptical interior walls of the hammer mechanism. The additional lamellas have been manufactured of one piece together with the output shaft and are staggered to the middle of the hammer mechanism. This way the main lamellas and the additional lamellas only contact the associated seal of the hammer mechanism's housing once in a 360° rotation of the hammer mechanism's housing, so that an impulse to the output shaft is generated at that moment.

The seal strips and the additional lamellas must be precisely manufactured in order for the additional lamella which forms one piece with the output shaft to seal against the associated cover strips of the hammer mechanism's housing without encountering obstructions. This is the reason that this hydro-impulse screw tool can only be manufactured at large scale and great cost. Additionally, the bearings of the output shaft are subjected to a disproportionate load at the time of the turning impulse due to the asymmetrical distribution of the lamellas, so that the bearing positions are subjected to considerable loads leading to premature wearing out.

SUMMARY OF THE INVENTION

The present invention was developed on the premise to construct a type of hydro-impulse screw tool in such a way that it can be manufactured simply and economically without interfering with the generation of the turning impulse.

In the newly invented hydro-impulse screw tool not only the main lamellas but also the additional lamellas are adjustably positioned in the output shaft. During rotation of the hammer mechanism's housing the additional lamellas are guided in their position in relation to the output shaft and the seal strips, in such a way that in a simple manner in a constructive sense, it is achieved that during a 360° rotation of the hammer mechanism's housing only in one specific position all lamellas are sealed against the associated seal strips. This way every time only one strike impulse is generated per 360° rotation and transferred to the output shaft. The guiding of the additional lamellas enables simple manufacturing of the associated seal strips while the means of guidance can be constructed in such a way that the additional lamellas will also seal unobstructed against the seal strips of the hammer mechanism's housing at greater manufacturing tolerances. This enables the main lamellas and the additional lamellas to be symmetrically positioned in relation to the output shaft, so that the output shaft and its bearing positions are not subjected to unequal loads during generation of the rotational impulse. This also leads to a longer lifetime for the hydro-impulse screw tool.

DESCRIPTION OF THE FIGURES

A better understanding of the hydro-impulse screw tool of the present invention may be obtained by reference to the drawings herein:

FIG. 1 is a side view of the hydro-impulse screwing tool of the present invention.

FIG. 2 is a sectional view of the hammer mechanism of the present invention, in the position where the output shaft is subjected to a strike of the hammer mechanism.

FIG. 3 is a sectional view of the hammer mechanism of the present invention, in the position where the output shaft of the hydro-impulse screw tool is not subjected to a strike.

FIG. 4 is a sectional view of the hammer mechanism of the present invention showing the main lamellas.

FIG. 5 is a sectional view taken at line V of FIG. 2.

FIG. 6 is a sectional view taken at line VI of FIG. 3.

DESCRIPTION OF THE EMBODIMENTS

Figure 7:
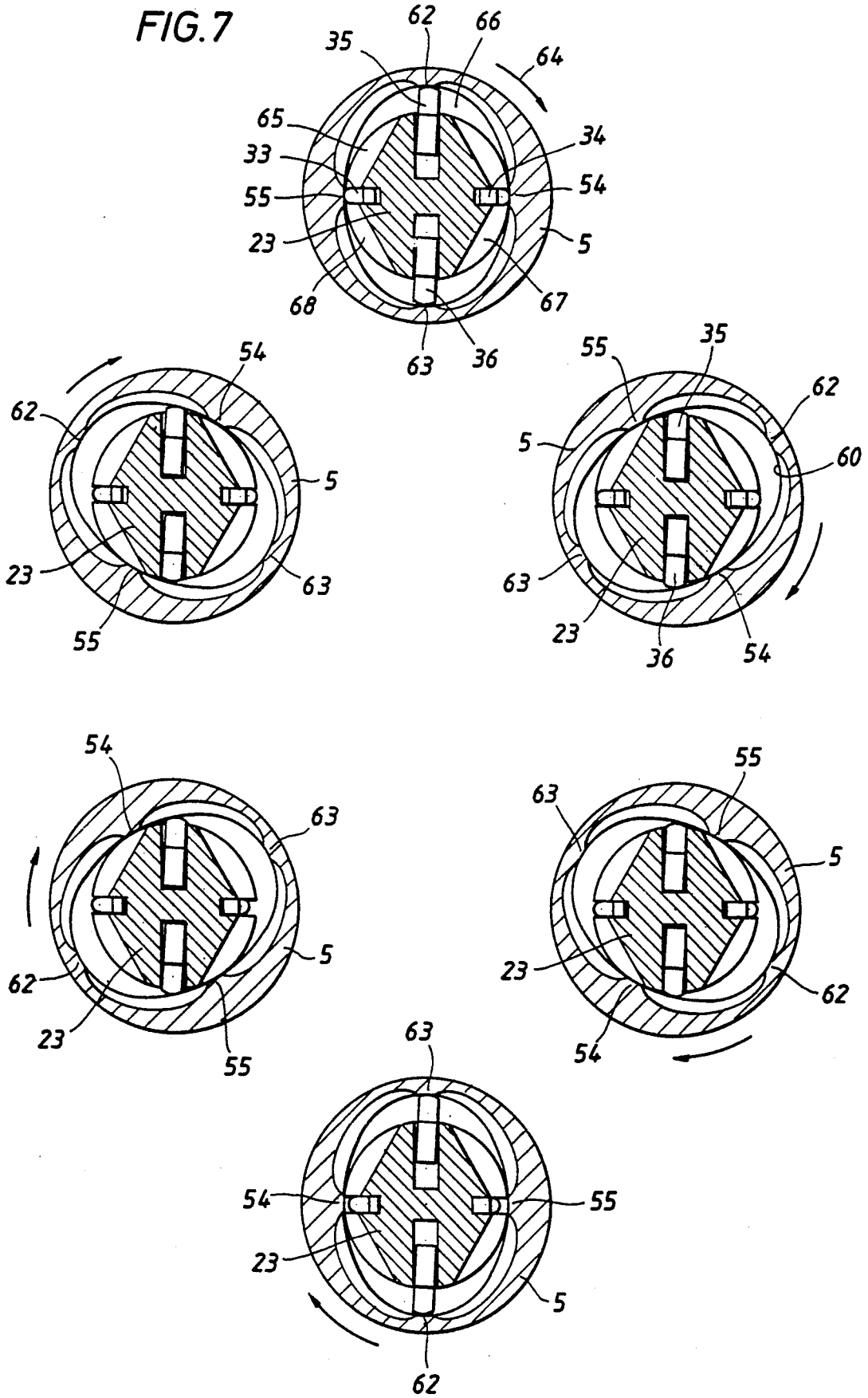
FIG. 7 is a schematic presentation of one rotation of the present invention.

The hydro-impulse screw tool which has only been schematically presented in FIG. 1 has a housing 1 in which an air compressor 2 and a hammer mechanism 3 are placed. Construction and operation of the air compressor 3 is known and described in DE-OS 37 17 630 by way of example. The housing of the hydro-impulse screw tool can accommodate any appropriate construction. The air compressor 2 has a drive shaft 4 which as only been schematically presented in FIG. 1 and which has been connected as drive mechanism to the housing 5 of the hammer mechanism 3 (FIG. 2).

Housing 5 of hammer mechanism 3 has a cylinder section 6 which accommodates a flange 7 which is radially aimed to the interior on the side of the output shaft. A cylinder section 6 with a circular recess 8 in which a hammer mechanism's top 9 has been inserted, is positioned at the other end. On it, a closing cap 10 has been placed which is also inserted into the recess 8 of the cylinder section 6 and of which the frontal side 11 which is averted away from the hammer mechanism's top 9, preferably has been placed flush with the front 12 of the cylinder section 6. The closing cap 10 is centrally equipped with a coupling piece 13 with which the housing 5 of the hammer mechanism 3 is coupled to the drive shaft 4 of the air compressor 2. The closing cap 10 is positioned in a planar manner in relation to the hammer mechanism's top 9 which has been centrally equipped with an axial ring collar 14. It projects into a recess 15 to which the inner side of the ring collar 14 is adjacent on the outside. The recess 15 is provided on the front side 16 of the closing cap 10 adjacent to the hammer mechanism's top 9.

In order to accomplish simple assembly of hammer mechanism 3, the hammer mechanism's top 9 is inserted loosely into recess 8 of the cylinder section 6. The corresponding front side 17 of the hammer mechanism's top 9 then is then adjacent to a radially continuing shoulder surface 18 of recess 8. In order for the hammer mechanism's top 9 to be precisely aligned in relation to cylinder section 6, at least one positioning rod 19 is provided which projects into the corresponding positioning openings 20 and 21 in cylinder section 6 and in the hammer mechanism's top 9. This way the hammer mechanism's top 9 can be specially installed in a precisely prescribed location. Closing cap 10 is screwed into recess 8 of cylinder section 6.

Cylinder section 6 with flange 7 and the hammer mechanism's top 9 form the end of a cylinder space 22 which is completely filled with a pressure agent, preferably hydraulic oil. An output shaft 23 runs through cylinder space 22 of which the ends are positioned in the cylinder section 6 as well as in the closing cap 10 in such a way that enables rotation, and which has not been drawn in the schematics. On the end of the output shaft 23, which is projecting from the output shaft side of the housing 5, a solid insertion 24 for instance a chuck has been provided.

The output shaft 23 can be rotated in relation to the hammer mechanism's housing 5. In the space between flange 7 of the cylinder section 6 and the hammer mechanism's top 9 the output shaft 23 has the diameter shape as depicted in FIG. 7. In this space it can however also take a more circle-form diameter as depicted in FIGS. 5 and 6. The flat ends that are depicted in FIGS. 5 and 6 at the outside of the output shaft 23 have been drawn only for clarification of the seal locations of the still to be described guiding lamellas. In reality the output shaft 23 has a circle form diameter in this construction example. This part of the output shaft 23 has been enlarged in the sectional view. To it, the end pieces with their smaller outside diameter 24 and 25 of the output shaft 23 are joined. With these end pieces the output shaft 23 is positioned in flange 7 of the cylinder section 6 and the hammer mechanism's top 9 in such a way that it can be rotated. The end pieces 25 and 26 are sealed with seals 27 and 28 across from flange 7 and the hammer mechanism's top 9. The extra thick piece of the output shaft 23 is positioned in cylinder space 22 and is provided with recesses 29 and 32 (FIG. 5) at 90° angles to each other in the outer surface. In recesses 29 and 31 which are diametrically opposed to one another there is also a guiding lamella 33 and 34, while the main lamella 35 and 36 have been placed in both other recesses 32 and 30 which are diametrically opposed to one another. As is shown in FIG. 2, the guiding lamellas 33 and 34 stretch between flange 7 of the cylinder section 6 and the hammer mechanism's top 9.

At both their ends which are opposite from each other, the guiding lamellas 33 and 34 have been provided with cam shaped extensions 37, 38 and 39, 40, which form guiding rails by which the guiding lamellas 33 and 34 are guided. The guiding rails 37 and 38 of the guiding lamella 33 are axially shorter than the guiding rails 39 and 40 of the diametrically opposed guiding lamella 34. To this purpose the guiding rails 37 and 38 are radially wider than the guiding rails 39, 40. The guiding rails 37 to 40 stretch from the long sides 41 and 42 of the guiding lamellas 33 and 34 which face each other. Every guiding lamella 33 and 34 is radially pressed to the outside by at least one pressure spring 43 and 44.

The guiding rails 37 and 38 of the guiding lamella 33 have each been assigned a steering track 45 and 46 in flange 7 of the cylinder section 6 and in the hammer mechanism's top 9. Also the guiding rails 39 and 40 of the guiding lamella 34 have each been assigned a steering track 47 and 48 in flange 7 of the cylinder section 6 and in the hammer mechanism's top 9. All steering tracks 45 to 48 have been provided in the side walls of recesses 49 and 50 in the opposing sides of flange 7 of the cylinder section 6 and of the hammer mechanism's top 9. The steering tracks 45 and 47 in flange 7 as well as 46 and 48 in the hammer mechanism's top 9 are positioned axially to one another. As is shown in FIG. 2, recess 49 and 50 have been constructed in a staggered manner for the construction of these steering tracks, whereby the steering tracks 45 and 46 have been provided in the opposing sides of flange 7 and of the hammer mechanism's top 9, while the steering tracks 47 and 48 have been assigned recesses in the sides that are turned away from each other and have been joined perpendicular to bottom 51 resp. 52 of the recesses 49 and 50. The steering tracks 45 and 47 as well as 46 and 48 in flange 7 and the in hammer mechanism's top 9 are each positioned on the side of an imaginary cylinder (FIG. 5). The generator of this cylinder side surfaces is parallel to the rotational axle of the output shaft 23. The steering tracks 45 and 46 have a greater diameter than the steering tracks 47 and 48. Moreover, steering tracks 45 and 47 as well as 46 and 48 have been constructed in such a way that they only move each other in one location 53 (FIG. 5).

Both diametrically opposed guiding lamellas 33 and 34 are guided by the steering tracks 45 and 48 during operation of the hydro-impulse screw tool in such a way still to be described, that they seal against the associated seal strips 54 and 55 (FIG. 5) only in one position in a 360° rotation of housing 5.

Both diametrically opposed main lamellas 35 and 36 are also powered by at least one, in the example drawing each time two pressure springs 56 to 59 (FIG. 4), with which they are radially pressed outward against the interior side 60 of cylinder space 22. Main lamellas 35 and 36 are T-shaped in the top view (FIG. 4) and the front of their lateral sides adjoin the opposing frontal sides 61 and 17 of flange 7 of cylinder section 6 and the hammer mechanism's top 9 (FIG. 4). Recesses 32 and 33 are shorter than the axial length of cylinder space 22 and than the recesses 29 and 31 for the guiding lamellas 33 and 34. Recesses 29 and 31 stretch over the entire axial length of the thickened central section of the output shaft 23, while recesses 32 and 30 are limited in the direction of their axes. The base of the main lamellas 35 and 36 fall into these recesses which are longer in their axial length than the bases of the main lamellas. Moreover, the width of recesses 30 and 32 is greater than the thickness of the main lamellas 35 and 36 (FIG. 5).

The interior wall 60 runs in the shape of an ellipse over a portion of the axial length (FIG. 5). Under pressure of the pressure springs 56 to 59 the main lamellas 35 and 36 are constantly pressed against the elliptical interior wall 60 during rotation of housing 5.

In order to start the hydro-impulse screw tool the air compressor 2 is started in the familiar manner. Drive shaft 4 of the air compressor 2 directly drives housing 5 of the hammer mechanism's top 9 across the coupling piece 13. The closing cap 10, the hammer mechanism's top 9 as well as the cylinder section 6 with the flange 7 this way form housing 5. The output shaft 23 is rotationally driven by the pressure agent in the cylinder space 22. This way the screw tool inserted into the notch 24 is turned and a screw or a bolt is screwed into the respective construction part. As long as the screw head or the bolt are still turning the drive shaft 4 and the output shaft 23 turn together. As soon however, as the screw head or the bolt tighten, output shaft 23 is subjected to a counter force. To tighten the screw or the bolt it is now required that the screw or the bolt is subjected to a turning moment by output shaft 23. Since the drive shaft 4 with the housing 5 of the hammer mechanism 3 can be rotated in relation to the output shaft 23, drive shaft 4 is further rotationally driven so that housing 5 turns in relation to the output shaft 23.

FIG. 5 shows how on the inside wall of cylinder section 6 four seal strips 54, 55, 62 and 63 have been provided at 90° angles of each other, that have been constructed of one piece together with cylinder section 6 and of which the top sides function as sealing surfaces.

FIG. 7 shows the direction of movement that results when the output shaft 23 continues to be turned in the direction of the impulse after the screw or bolt tighten. In the top drawing the diametrically opposed main lamellas 35, 36 and also the diametrically opposed guiding lamellas 33, 34 are sealed against the seal strips 54, 55 62, 63. This creates four adjacent sickle-shaped, closed-off spaces 65 to 68. Due to the rotational direction 64 of housing 5 as drawn, high pressure forms in spaces 65 and 67, i.e. in rotational direction 64 both behind main lamellas 35 and 36, while low pressure forms in the spaces 66 and 68 in front of the main lamellas 35 and 36 in the rotational direction 64. Due to the sealed spaces the built-up pressure is in this position transferred to the output shaft 23, which is turned in accordance with the impulse in direction 64 of housing 5. Since the recesses 30 and 32 in the output shaft 23 are wider than the main lamellas 35 and 36 they can take a slanting position at the time of the impulse as is shown in FIG. 5 as well as in the top drawing of FIG. 7. This way ample space is created to push out the pressure agent from the under-pressure spaces 66 and 68. This pressure agent can be pushed into the recesses 30 and 32.

When housing 5 is rotated further the seal strips 54, 55, 62 and 63 are released from the main lamellas 35 and 36 and the guiding lamellas 33 and 34. The main lamellas 35 and 36 are pushed against the elliptical interior wall 60 under pressure from springs so that they are pushed against this interior wall during rotation of housing 5. Both guiding lamellas 35 and 36 are pressed under spring pressure, together with their guiding rails 37 to 40 against the associated steering tracks 45 to 48 which are each placed on a cylinder wall and positioned in such a way that the guiding lamellas 33 and 34 only seal against the seal strips 54 and 55 of housing 5 in the impulse position (FIG. 5 as well as the top drawing in FIG. 7). Once housing 5 has been turned 180° of the rotational phase, the position exists as in FIG. 6 and the bottom drawing of FIG. 7. In this position the main lamellas 35 and 36 seal against the seal strips 63 and 62 of which the frontal side lies against the elliptical interior wall 60. The guiding lamellas 33 and 34 on the other hand are at a distance from the seal strips 54 and 55 in this position. The guiding lamellas 33 and 34 are guided by their guiding rails 37 to 40 and the steering tracks 45 to 48 in such a way that they do not seal against the corresponding seal strips 54 and 55 of housing 5 after the 180° rotation of housing 5. This way no pressure is formed in the cylinder spaces in this position. The impulse generated by the main lamellas 35 and 36 passes without pressure. This way output shaft 23 can be further accelerated. Housing 5 continues to turn in rotational direction 64 whereby the main lamellas 35 and 36 are against the elliptical interior wall 60 under spring-pressure and the guiding lamellas 33 and 34 are guided over their sliding tracks 37 to 40 through the steering tracks 45 to 48. Due to the eccentric position of the steering tracks 45 to 48 the guiding lamellas 33 and 34 are again forced radially outward during the following 180° rotation of housing 5 until they again seal against the seal strips 62 and 63 after a 360° rotation of housing 5 (FIG. 5 and top drawing of FIG. 7). Only now the output shaft 23 receives another impulse.

Due to the construction as described it becomes possible in the case of this hydro-impulse screw tool to accelerate the output shaft 23 over the entire rotational range of 360° of housing 5 and to extract the greatest speed possible from each single impulse. Since all lamellas 33 to 36 are pressed under spring pressure against the associated steering tracks 45 to 48 a flexible adaptation is guaranteed which secures an airtight seal and through which an improved impulse quality and accuracy of turning moment is achieved. As a consequence of this flexible adaptation greater manufacturing tolerances can be allowed so that hammer mechanism 3 and thus the entire hydro-impulse screw tool can be manufactured more economically and additionally be easier installed. Especially the steering tracks 45 to 48 do not need to be manufactured to extreme specifications since greater tolerances can be allowed without penalty due to the spring action pressure of the guiding lamellas 33 and 34. The outside diameter of the hammer mechanism 3 can be kept small due to the four moveable lamellas 33 to 36. During the acceleration phase which takes place over the entire rotation of 360° undesired movement of housing 5 is out of the question due to the guiding lamellas 33 and 34.

The various cylinder spaces 65 to 68 are not connected in the impulse position (FIG. 5 and the top drawing in FIG. 7), because the guiding lamellas 33 and 34 seal against the front sides of the steering tracks 45 to 48 which point in axial direction. The frontal surfaces of the output shaft 23 seals against flange 7 and the hammer mechanism's top 9 and separates the over-pressure spaces 65 and 67 from the under-pressure spaces 66 and 68 in an airtight manner.

The hydro-impulse screw tool can be switched off in the usual manner after tightening of the screws or bolts.

According to the present invention, there is provided a hydro-impulse screw tool which generates only one impulse per rotation of the output shaft. Still other embodiments of the hydro-impulse screw tool will become apparent to those of ordinary skill in the art once having read the foregoing description and accompanying claims.

We claim:

1. A hydro-impulse screw tool comprising:

a flange in the shape of a cup, said flange having an inner side forming the bottom and sides of a housing;

a rotationally driven hammer mechanism having an output shaft as a screw mechanism, said hammer mechanism positioned within said housing;

a top, said top being opposite of said bottom of said flange and encasing said hammer mechanism within said housing;

two opposing main lamellas on said output shaft, said main lamellas constructed and arranged to be radially adjustable;

two opposing additional lamellas on said output shaft, said additional lamellas together with said main lamellas adjoin on said output shaft at an angle to said housing of said hammer mechanism; said additional lamellas having guide rails, at least four seal strips on said inner side of said housing to engage said lamellas at points on said inner side of said housing corresponding to said angle of said lamellas on said output shaft;

means for positioning said additional lamellas on said output shaft to engage selected seal strips for the generation of a turning impulse to said output shaft by sealing said lamellas against said seal strips, said housing of said hammer mechanism has steering tracks, said steering tracks being shaped by recesses in said bottom of said flange and said top, wherein said means for positioning said additional lamellas on said output shaft comprises arranging said guide rails of said additional lamellas to ride within said respective steering tracks of said bottom of said flange and said top, wherein said steering tracks associated with one of said additional lamellas is axially positioned in relation to said steering tracks of said other of said additional lamellas.

2. The hydro-impulse screwing tool as defined in claim 1 wherein said steering tracks form cylindrical surfaces.

3. The hydro-impulse screwing tool as defined in claim 1 wherein said steering tracks form a conic section.

4. The hydro-impulse screwing tool as defined in claim 2 wherein said steering tracks associated with said one of said additional lamellas has a greater diameter than the steering tracks associated with said other of said additional lamellas.

5. The hydro-impulse screwing tool as defined in claim 4 wherein said steering tracks with a smaller diameter are positioned eccentrically in relation to said steering tracks with said greater diameter.

6. The hydro-impulse screwing tool as defined in claim 5 wherein aid additional lamellas have biasing means for biasing said additional lamellas against said respective steering tracks.

7. The hydro-impulse screwing tool as defined in claim 6 wherein said biasing means includes a spring.

* * * * *